US010710688B2

(12) United States Patent
Huber

(10) Patent No.: US 10,710,688 B2
(45) Date of Patent: Jul. 14, 2020

(54) MARINE PROPELLER

(71) Applicant: INDIGO POWER SYSTEMS LLC, Tequesta, FL (US)

(72) Inventor: David J. Huber, Tequesta, FL (US)

(73) Assignee: Indigo Power Systems, LLC, Tequesta, FL (US)

( * ) Notice: Subject to any disclaimer, the term of this patent is extended or adjusted under 35 U.S.C. 154(b) by 414 days.

(21) Appl. No.: 15/462,939

(22) Filed: Mar. 20, 2017

(65) Prior Publication Data

US 2017/0274971 A1 Sep. 28, 2017

Related U.S. Application Data

(60) Provisional application No. 62/313,283, filed on Mar. 25, 2016.

(51) Int. Cl.
*B63H 1/26* (2006.01)
*B63H 1/20* (2006.01)

(52) U.S. Cl.
CPC ..... *B63H 1/26* (2013.01); *B63H 1/20* (2013.01)

(58) Field of Classification Search
CPC .... B63H 1/14; B63H 1/20; B63H 1/26; Y10S 416/02

(Continued)

(56) References Cited

U.S. PATENT DOCUMENTS 1,882,164 A * 10/1932 Ross ..... B63H 1/26 29/889.6
3,224,509 A * 12/1965 Thompson ..... B63H 1/26 416/132 R (Continued)

FOREIGN PATENT DOCUMENTS

GB 216170 A * 5/1924 ..... B63H 1/26
GB 289897 A * 7/1929 ..... B63H 1/18

(Continued)

OTHER PUBLICATIONS

Del Ogren, "Some Propeller Fundamentals," Mar. 31, 2003 (via http://archive.org), <"http://n-lemma.com/indoorrc/propcalc.htm">.*

*Primary Examiner* — John M Zaleskas

(74) *Attorney, Agent, or Firm* — Rafael Perez-Pineiro, Esq.; The Brickell IP Group, PLLC

(57) ABSTRACT

A marine propeller includes a plurality of blades attached to a hub, with a disk area ratio of approximately 50%, a blade area ratio of approximately 61%, a blade rake angle of approximately 26.5 degrees, a blade skew angle of approximately 0 degrees, and wherein the angle between the chord line at any given radius r on said blades with a line that is parallel to the propeller axis of rotation and intersects the chord line, is equal to $\tan^{-1}(2\pi Nr/Vo)-\alpha$, where N is the rotational speed of the propeller at a selected design condition, Vo is the speed of the water entering the propeller (i.e. the speed of the vessel) at the design condition, and $\alpha$ is the angle of attack at the radius r at said design condition, and where a is generally constant across most or all of the span of the blades at the design condition, and where the value of $\alpha$ may be selected to be lower near the hub than for the remainder of blade, and where additional camber is provided in the leading edge region, such that leading edge camber line angle of attack is reduced relative to the chord line angle of attack for the overall blade section.

10 Claims, 2 Drawing Sheets

(58) Field of Classification Search
USPC ..... 416/DIG. 2
See application file for complete search history.

(56) References Cited

U.S. PATENT DOCUMENTS

| | | | | | |
|---|---|---|---|---|---|
| 4,067,116 | A * | 1/1978 | Bryner | G01L 35/205 | 33/343 |
| 4,073,601 | A * | 2/1978 | Kress | B63H 1/26 | 416/223 R |
| 4,780,058 | A * | 10/1988 | Phillips | B63H 1/26 | 416/223 R |
| 4,802,822 | A * | 2/1989 | Gilgenbach | B63H 1/26 | 416/235 |
| 4,865,520 | A * | 9/1989 | Hetzel | B63H 1/26 | 416/236 R |
| 5,104,292 | A * | 4/1992 | Koepsel | B63H 1/26 | 416/223 R |
| 5,180,286 | A * | 1/1993 | Dean | B63H 1/20 | 29/889.6 |
| 5,236,310 | A * | 8/1993 | Koepsel | B63H 1/26 | 416/223 R |
| 5,405,243 | A * | 4/1995 | Hurley | B63H 1/16 | 416/189 |
| 5,791,874 | A * | 8/1998 | Lang | B63H 1/20 | 29/889.1 |
| 5,800,223 | A * | 9/1998 | Iriono | B63H 1/26 | 416/128 |
| 5,807,151 | A * | 9/1998 | Sumino | B63H 1/26 | 416/129 |
| 7,637,722 | B1 * | 12/2009 | Koepsel | B63H 1/26 | 416/238 |
| 9,745,948 | B1 * | 8/2017 | Koepsel | F03B 3/121 | |
| 2004/0214485 | A1 * | 10/2004 | Schmidt | B63H 5/07 | 440/79 |
| 2005/0025626 | A1 * | 2/2005 | Buzzi | B63H 1/18 | 416/236 R |
| 2005/0175458 | A1 * | 8/2005 | Romero Vazquez | B63H 1/14 | 416/204 R |
| 2005/0233654 | A1 * | 10/2005 | Mueller | B63H 3/008 | 440/49 |
| 2007/0065282 | A1 * | 3/2007 | Patterson | B63H 1/20 | 416/93 A |
| 2010/0074756 | A1 * | 3/2010 | Lin | B63H 1/20 | 416/223 R |
| 2011/0143612 | A1 * | 6/2011 | Kuriyagawa | B63H 21/21 | 440/86 |

FOREIGN PATENT DOCUMENTS

| | | | | |
|---|---|---|---|---|
| GB | 340000 | A * | 12/1930 | B63H 1/26 |
| GB | 404631 | A * | 1/1934 | B63H 1/26 |

* cited by examiner

MARINE PROPELLER

CROSS REFERENCE TO RELATED APPLICATION

This application claims priority to United States Provisional Patent Application Ser. No. 62/313,283 filed on Mar. 25, 2016 and incorporated by reference in its entirety herein.

TECHNICAL FIELD

The present disclosure generally relates to marine propellers. More particularly, the present disclosure relates to a propeller specifically designed to provide improved performance and efficiency across the entire range of diverse operating conditions experienced by propellers used on planing vessels, which include low-speed displacement mode operation, transition from displacement mode operation to planing mode operation, and the full range of planing mode operation speeds, and for which operation at maximum power results in increased maximum speed of the vessel.

BACKGROUND

U.S. Pat. No. 7,637,722 which issued to Koepsel, et. al. on Dec. 29, 2009, describes a marine propeller configured to improve maximum velocity, acceleration, and cruise speed characteristics of a marine vessel.

U.S. Patent No. 2007/0065282 which issued to Patterson on Mar. 22, 2007, describes a propeller and apparatus wherein the propeller includes two blade sets of distinctly different geometries, and a propeller hub ring extender.

The patents described above are hereby incorporated by reference in the description of the several implementations set forth below.

SUMMARY

The following presents a simplified summary of the disclosure in order to provide a basic understanding of some aspects of the disclosure. This summary is not an extensive overview of the disclosure. It is intended neither to identify key or critical elements of the disclosure nor to delineate the scope of the system and method disclosed herein. Its sole purpose is to present some concepts of the disclosure in a simplified form as a prelude to the more detailed description that is presented later.

In one embodiment, a propeller comprises a hub about an axis of rotation, and having blades attached to the hub that extent radially outward from the hub. The design of the hub is tapered to reduce pressure drag while optimizing this drag reduction against increased engine exhaust pressure to maximize overall performance, and extends significantly past the trailing edges of the blades to both maximize the drag reduction and to prevent exhaust gases from flowing upstream into the blades along the hub surface.

In one embodiment, a propeller with 4 blades has a disk area ratio of approximately 50%, a blade area ratio of approximately 61%, a blade skew angle of approximately 0 degrees, a blade rake angle of about 26.5 degrees, a generally elliptical chord distribution, a camber distribution selected to effect a generally uniform load distribution, a pitch distribution yielding an approximately constant angle of attack across the span of the blade at a selected design point condition (with allowance at the root for reduced angle of attack relative to the remainder of the blade span), a leading edge with a relatively high camber (roll), such that leading edge camber line angle of attack is reduced relative to the chord line angle of attack, and a trailing edge with a relatively high camber (cup) along the trailing edge.

DESCRIPTION

Figure 1:
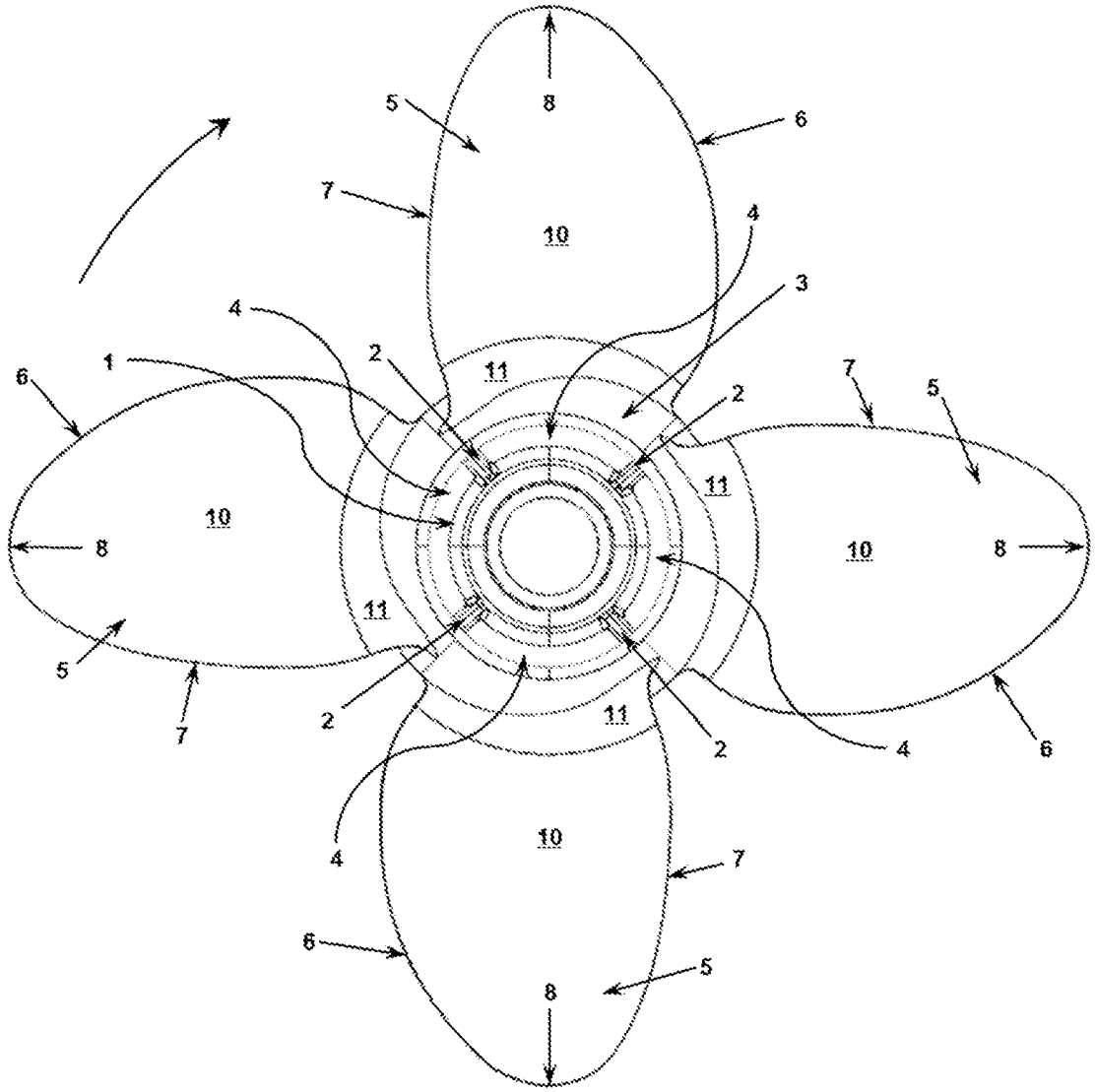
FIG. 1 illustrates a marine propeller in accordance with one embodiment, viewed from directly behind the propeller.

The system and method disclosed herein will now be described more fully hereinafter with reference to the accompanying drawings, in which preferred implementations are shown. The disclosed system and method may, however, be implemented in many different forms and should not be construed as limited to the implementations set forth herein. Rather, these implementations are provided so that this disclosure will be thorough and complete, and will fully convey the scope of the disclosed system and method to those skilled in the art.

Marine propellers for planing vessels are required to operate across a wide range of diverse operating conditions, including low-speed displacement mode operation, mid-speed transition from displacement mode operation to planing mode operation (or in the case of semi-displacement vessels, semi-displacement mode operation), and across a wide range of higher speeds in planing mode operation. For such vessels, the engine may be of the outboard, inboard-outboard (also known as 'sterndrive'), or inboard type. For outboard and sterndrive configurations, engine manufacturers have developed individual propulsion system designs that may be applied to many different vessels and which include a lower gearcase that operates under the surface of the water, with a splined propeller shaft protruding generally aft from the gearcase, onto which the propeller is installed. Typically, the engine exhaust is ducted out of the gearcase outside the circumference of the propeller shaft and through the propeller hub, after which it is exhausted into the environment. These mass-produced propulsion system designs, along with standard drive sleeves that mate the propeller inner hub to the splined propeller shaft and which may be made of either rigid material such as metal, or a pliable material such as nylon or rubber, allow for a given propeller design to be used on a variety of engine makes and models.

Propellers for planing vessels must perform acceptably across the entire range of diverse operating conditions, even though the optimal propeller design parameters for each condition may vary widely. For instance, a large diameter propeller allows for excellent propulsive efficiency in low-speed displacement mode operation and also allows for rapid acceleration at lower speeds, but suffers from higher drag at higher speeds, resulting in lower efficiency when operating at higher speeds, and lower maximum speed of the vessel. Similarly, the many other propeller design parameters that together comprise a complete definition of the geometry (such as disk area ratio, blade area ratio, skew, rake, chord distribution, camber distribution, pitch distribution, leading edge roll, and trailing edge cup) may each have an optimal value at one operating condition, and a completely different optimal value at another operating condition. As such, propellers designed for planing vessels represent a compromise in design parameters in order to achieve acceptable overall performance, or specific attributes at a subset of operating conditions. Aspects of the embodiments described herein may allow for reduction in or minimization of the performance compromises between operating conditions via a combination of design features, such that performance may be increased at all operating conditions, resulting in increased efficiency and maximum speed of the vessel.

FIG. 1 illustrates a propeller in accordance with one embodiment, as viewed from directly behind the propeller. The propeller illustrated in FIG. 1 includes Inner Hub 1, Ribs 2, Outer Hub 3, Exhaust Passages 4, Blades 5, Blade Leading Edges 6, Blade Trailing Edges 7, Blade Tips 8, Blade Pressure Surfaces 10, and Blade Fillets 11.

Inner Hub 1 may be implemented as a receptacle for a standard drive sleeve which may be made of either rigid material such as metal or a pliable material such as nylon or rubber, and which mates Inner Hub 1 to the splined propeller shaft (not shown). Inner Hub 1 may also be implemented as a hub to transfer torque between the propeller shaft/drive sleeve and Ribs 2, and to transmit the propeller thrust load to the propeller shaft via a thrust face which acts on a thrust washer or other thrust surface located on the propeller shaft. Ribs 2 may be implemented as structural members connecting Inner Hub 1 to Outer Hub 3, to transmit torque between Inner Hub 1 and Outer Hub 3. Outer Hub 3 may be implemented as a generally cylindrical body that may be implemented to include a smooth curved taper profile (from fore to aft) to reduce pressure drag due to flow separation while optimizing this drag reduction against increased engine exhaust pressure to maximize overall performance, and which may be implemented to extend significantly past Trailing Edges 7 of Blades 5 both to maximize the drag reduction and to prevent exhaust gases from flowing upstream into Blades 5 along the surface of Outer Hub 3. Outer Hub 3 may also be implemented with a small acute angle lip at its trailing edge, to further prevent exhaust gas from traveling upstream by creating an impingement surface for the flow of water outside the boundary layer as it flows along Outer Hub 3, and which is much smaller than conventional 'diffuser rings' used on propellers to reduce such backflow and to reduce engine back pressure; for example, such an impingement surface may be less than or equal to 3 millimeters height in the radial direction. Exhaust Passages 4 may be implemented as spaces between Inner Hub 1 and Outer Hub 3, and annularly located between Ribs 2, for the purpose of conveying exhaust from the engine. Blades 5 may be implemented as propeller blades attached to Outer Hub 3 via Blade Fillets 11. Blades 5 may be implemented as having multiple features, including Blade Leading Edges 6 which are the forward edges of Blades 5, Blade Trailing Edges 7 which are the rearward edges of Blades 5, Blade Tips 8 which are the ends of the mid-chord lines on Blades 5, and which separate the Blade Leading Edges 6 from the Blade Trailing Edges 7, Blade Pressure Surfaces 10, which are the aft-facing surfaces of Blades 5, and Blade Fillets 11 which are the roots of Blades 5 and may be implemented with increased thickness near Outer Hub 3 as compared to the general thickness of Blades 5 at locations distal to Outer Hub 3 to provide the strength to withstand the high mechanical stresses at the blade roots.

Figure 2:
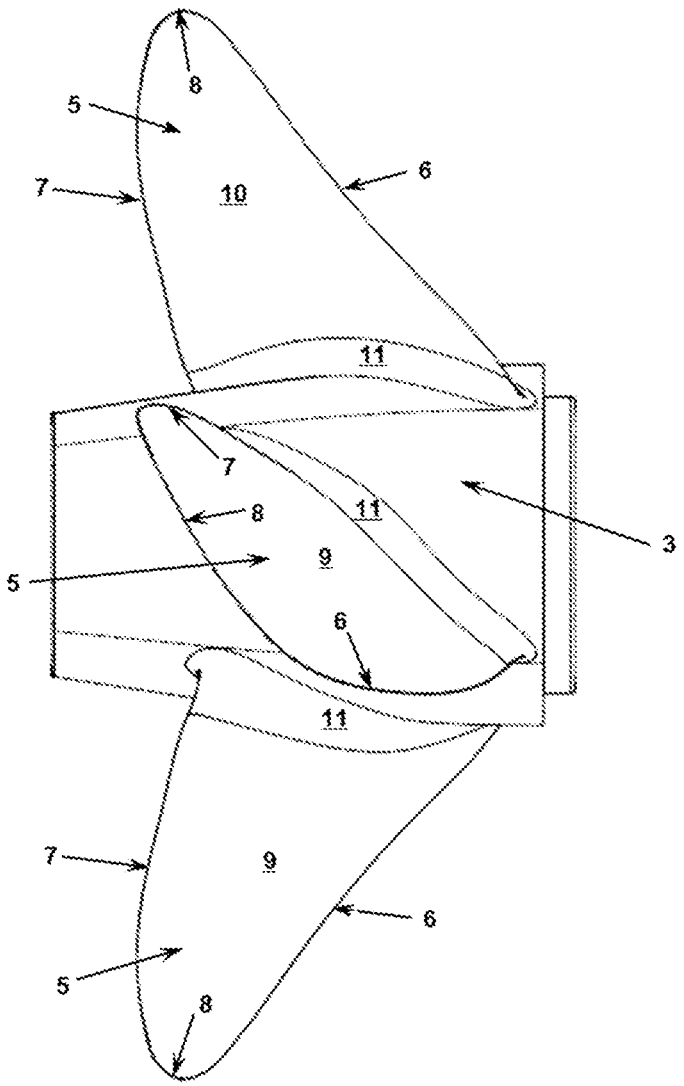
FIG. 2 illustrates a marine propeller in accordance with one embodiment, viewed from the side of the propeller.

FIG. 2 illustrates a propeller in accordance with one embodiment, as viewed from one side of the propeller. In one embodiment, all parts illustrated in FIG. 1 are also present in the embodiment illustrated in FIG. 2. The FIG. 2 illustration also depicts an additional part not illustrated in FIG. 1—Blade Suction Surfaces 9, which are the forward-facing surfaces of Blades 5.

Although the above discussion references multiple parts and features of the subject disclosure, this is primarily to facilitate the description of the subject disclosure and not to identify physically separate material parts. The disclosed propeller may be implemented as a single continuous part, for example by casting of molten material, machining from a single billet of material, printing via the developing technology of three-dimensional printing, or by other means generally known or developed in accordance with known technologies or principles. As such, it is understood that the geometry and features described herein are not intended to limit the manufacturing execution of the subject disclosure.

In some circumstances, operation of the marine propeller illustrated in FIGS. 1 and 2 is as follows. In one embodiment, torque is transmitted between the propeller shaft/drive sleeve and Ribs 2 by Inner Hub 1, between Inner Hub 1 and Outer Hub 3 by Ribs 2, between Ribs 2 and Blade Fillets 11 by Outer Hub 3, and between Outer Hub 3 and Blades 5 by Blade Fillets 11. In one embodiment, Outer Hub 3 reduces pressure drag due to flow separation while optimizing this drag reduction against increased engine exhaust pressure to maximize overall performance, and may also prevent exhaust gases from flowing upstream into the blades along the surface of Outer Hub 3. In one embodiment, Exhaust Passages 4 convey the engine exhaust gases from the exit of the lower gearcase to the environment aft of the propeller. In one embodiment, Blades 5 (consisting of Blade Leading Edges 6, Blade Trailing Edges 7, Blade Tips 8, Blade Suction Surfaces 9, and Blade Pressure Surfaces 10), along with Blade Fillets 11, provide a thrust force resulting from the rotation of the propeller due to the applied torque from the propeller shaft/drive sleeve, which is transmitted through Outer Hub 3 and Ribs 2, to Inner Hub 1. Additionally, Inner Hub 1 may transmit the propeller thrust force to the propeller shaft via a thrust face which acts on a thrust washer or other thrust surface located on the propeller shaft.

In one embodiment, Blades 5 (consisting of Blade Leading Edges 6, Blade Trailing Edges 7, Blade Tips 8, Blade Suction Surfaces 9, and Blade Pressure Surfaces 10), along with Blade Fillets 11, provide for improved propeller performance and efficiency across the entire range of diverse operating conditions experienced by propellers used on planing vessels, which include low-speed displacement mode operation, transition from displacement mode operation to planing mode operation, and the full range of planing mode operation speeds, and for which operation at maximum power results in increased maximum speed of the vessel, by employing a disk area ratio of approximately 50%, a blade area ratio of approximately 61%, a blade skew angle of approximately 0 degrees, a blade rake angle of approximately 26.5 degrees, an approximately elliptical chord distribution, and a camber distribution selected or designed to effect a generally uniform load distribution, with additional camber at Blade Leading Edges 6 and Blade Trailing Edges 7 as described below. Additionally in this embodiment, a pitch distribution yielding a generally constant angle of attack across the span of the blade at a selected design condition, for example at a high-slip operating condition during the transition from displacement mode operation to planing mode operation, and which may deviate near Outer Hub 3 to allow for reduced angle of attack relative to the remainder of the blade span, and wherein the angle between the chord line at a given radius r on Blades 5 with a line that both is parallel to the propeller axis of rotation and intersects the chord line, is generally equal to $\tan^{-1}(2\pi Nr/Vo)-\alpha$, where N is the rotational speed of the propeller at the selected design condition, Vo is the speed of the water entering the propeller (i.e. the speed of the vessel) at the selected design condition, and $\alpha$ is the angle of attack at radius r on Blades 5 at the selected design condition, and where the value of $2\pi N/Vo$ is generally equal to 20.38, and where the value of $\alpha$ is generally constant and equal to about 13.84 degrees, and with an exception near Outer Hub 3 where $\alpha$ is generally equal to about 11.84 degrees. Additionally in this embodiment, additional camber along Blade Leading Edges 6, that reduces the leading edge camber line angle of attack relative to the chord line angle of attack, such that the leading edge camber line angle of attack at the same high-slip condition where the pitch distribution is defined is generally negative 2 degrees near Outer Hub 3, generally negative 7 degrees in the mid-span region of Blades 5, and with reducing additional camber towards Blade Tips 8. Additionally, this embodiment may employ additional camber along Blade Trailing Edges 7 (commonly referred to as 'cup').

For ease of reference, the embodiment illustrated in FIGS. 1 and 2 is referred to as a "first" embodiment, but persons of ordinary skill in the art would recognize that such first embodiment includes variations in implementation and operation.

Another embodiment is contemplated, for example, wherein the disk area ratio is between about 40% and about 60%.

Another embodiment is contemplated, for example, wherein the blade area ratio is between about 55% and about 65%.

Another embodiment is contemplated, for example, wherein the blade skew angle is between about 0 degrees and about 40 degrees.

Another embodiment is contemplated, for example, wherein the blade rake angle is between about 20 degrees and about 35 degrees.

In accordance with another embodiment, the chord distribution may not be elliptical.

In accordance with another embodiment, the camber distribution may be implemented such that it does not generally yield a generally uniform load distribution.

In yet another embodiment, the value of $\alpha$ defining the pitch distribution need not be reduced near Outer Hub 3, such that the entire blade span has the same angle of attack at the selected design condition where the pitch distribution is defined.

In some other embodiments, the value of $2\pi N/Vo$ defining the pitch distribution may be of any value; additionally or alternatively, the value of $\alpha$ defining the pitch distribution may be of any value.

Another embodiment is contemplated, for example, wherein the additional camber along Blade Leading Edges 6 yields a leading edge camber line angle of attack that is generally lower than the chord line angle of attack.

In still another embodiment, there may be no additional camber (as compared to the chord line) along Blade Leading Edges 6, Blade Trailing Edges 7, or both.

The foregoing description of possible implementations consistent with the method and system disclosed herein does not represent a comprehensive list of all such implementations or all variations of the implementations described. The description of only some implementations should not be construed as an intent to exclude other implementations. For example, artisans will understand how to implement the system and method disclosed herein in many other ways, using equivalents and alternatives that do not depart from the scope of the system and method disclosed herein. Moreover, unless indicated to the contrary in the preceding description, none of the components described in the implementations is essential to the system and method disclosed herein. It is thus intended that the specification and examples be considered as exemplary only.

The invention claimed is:

1. A marine propeller comprising:

a hub; and a plurality of blades attached to said hub and configured such that an angle between a chord line at any given radius on said blades and a line that is parallel to a propeller axis of rotation and intersects said chord line, is equal to $$\tan^{-1}(2\pi Nr/Vo)-\alpha,$$

where N is the rotational speed of said marine propeller at a specific pre-selected design condition, Vo is the speed of the water entering said marine propeller at said design condition, and a is an angle of attack at said radius r at said design condition, and wherein $\alpha$ is a constant non-zero value across the span of said blades at said design condition, wherein the selected fixed values for N, Vo, and $\alpha$ define a specific radial pitch distribution for said marine propeller.

2. The marine propeller of claim 1 wherein said plurality of blades comprises four blades.

3. The marine propeller of claim 1 wherein said plurality of blade comprises three blades.

4. The marine propeller of claim 1 wherein said angle of attack $\alpha$ is 13.84 degrees.

5. The marine propeller of claim 1 wherein each of said plurality of blades has a skew angle between 0 degrees and 10 degrees.

6. The marine propeller of claim 1 wherein each of said plurality of blades has a rake angle between 25 degrees and 30 degrees.

7. The marine propeller of claim 1 wherein each of said plurality of blades has a chord distribution that is elliptical.

8. The marine propeller of claim 1 wherein a camber is provided in a trailing edge region of each of said plurality of blades.

9. The marine propeller in claim 1 wherein said hub is tapered.

10. The marine propeller in claim 1 wherein said hub extends significantly past a trailing edge of each of said plurality of blades.

* * * * *